United States Patent [19]

Bullock

[11] 3,977,608

[45] Aug. 31, 1976

[54] ATOMIZING SYSTEM AND ATOMIZING NOZZLE ASSEMBLY

[76] Inventor: Alan R. Bullock, 29 Division St., Bangor, Maine 04401

[22] Filed: July 24, 1975

[21] Appl. No.: 598,812

[52] U.S. Cl. ..... 239/410; 239/307; 239/308; 239/354; 239/371; 239/351

[51] Int. Cl.[2] ..... B05B 7/12

[58] Field of Search ..... 239/340–342, 239/346, 318, 311, 315, 371, 307, 308, 344, 349, 354, 435, 570, 351, 407, 410, 411, 417.3; 137/101.11, 99, 480, 482; 417/213, 216

[56] References Cited

UNITED STATES PATENTS

| | | | |
|---|---|---|---|
| 1,787,583 | 1/1931 | Larson | 239/371 X |
| 1,834,061 | 12/1931 | Joachim | 239/410 |
| 2,372,678 | 4/1945 | McKay | 239/342 |
| 2,697,007 | 12/1954 | Wille | 239/410 X |
| 3,123,304 | 3/1964 | Sutton | 239/308 X |
| 3,521,817 | 7/1970 | Curtis et al. | 239/307 X |

*Primary Examiner*—Robert S. Ward, Jr.
*Attorney, Agent, or Firm*—Samuel Meerkreebs

[57] ABSTRACT

An atomizing system including an improved nozzle assembly in which one or more fluids are mixed and dispersed as droplets from a conical bore controlled by means for adjusting the size of a dispersal orifice in conjunction with means for automatically operating the improved nozzle assembly from a pressure source which simultaneously supplies a pressurized gas and liquid to the valve assembly.

12 Claims, 9 Drawing Figures

AIR OR GAS
LIQUID SOURCE
P
M
P

10

72'
72
74
74
70
70
34
70
68
66
44
58
56
52
46
26'
62
60
26
64
43
42
43
48
28
28
29'
36
38
37
40

38
T
40

ATOMIZING SYSTEM AND ATOMIZING NOZZLE ASSEMBLY

BACKGROUND OF THE INVENTION

This invention relates to applicant's copending application Ser. No. 427,458 filed Mar. 6, 1974, now abandoned.

In the past it has been difficult to control the amount of liquid dispersed as an atomized spray, this generally having been accomplished in relation to the velocity gaseous vehicle which has aspirated the liquid to an outlet nozzle at a relatively high velocity, and upon striking the atmosphere results in an atomized dispersion.

OBJECTS OF THE INVENTION

Primary objects of the invention are to provide a novel system and dispersion nozzle in which a mixture of gas and liquid can be readily controlled and dispersed as an atomized mixture in an efficient and controlled manner.

The invention more particularly relates to atomizing of a liquid and gas mixture in which an adjustable, spring-biased diaphragm includes a valving portion urged onto a valve seat controlling liquid-flow, the valve seat being intersected by an axial gas-passage communicating with an outlet orifice; the outlet orifice comprising a cylindrical bore; a conical bore or a conical bore cooperating with a conical needle valve carried by a control diaphragm subject to pressure of the liquid being dispersed or atomized.

A more particular object of the invention is to provide a dispersion nozzle of the character set forth above including mechanical control means for positively controlling dispersion of a mixture of fluids.

These, together with other and more specific objects and advantages of the invention, will become apparent from the following description when taken in conjunction with the drawing forming a part thereof, in which:

DESCRIPTION OF PREFERRED EMBODIMENTS

Figures 1, 2:
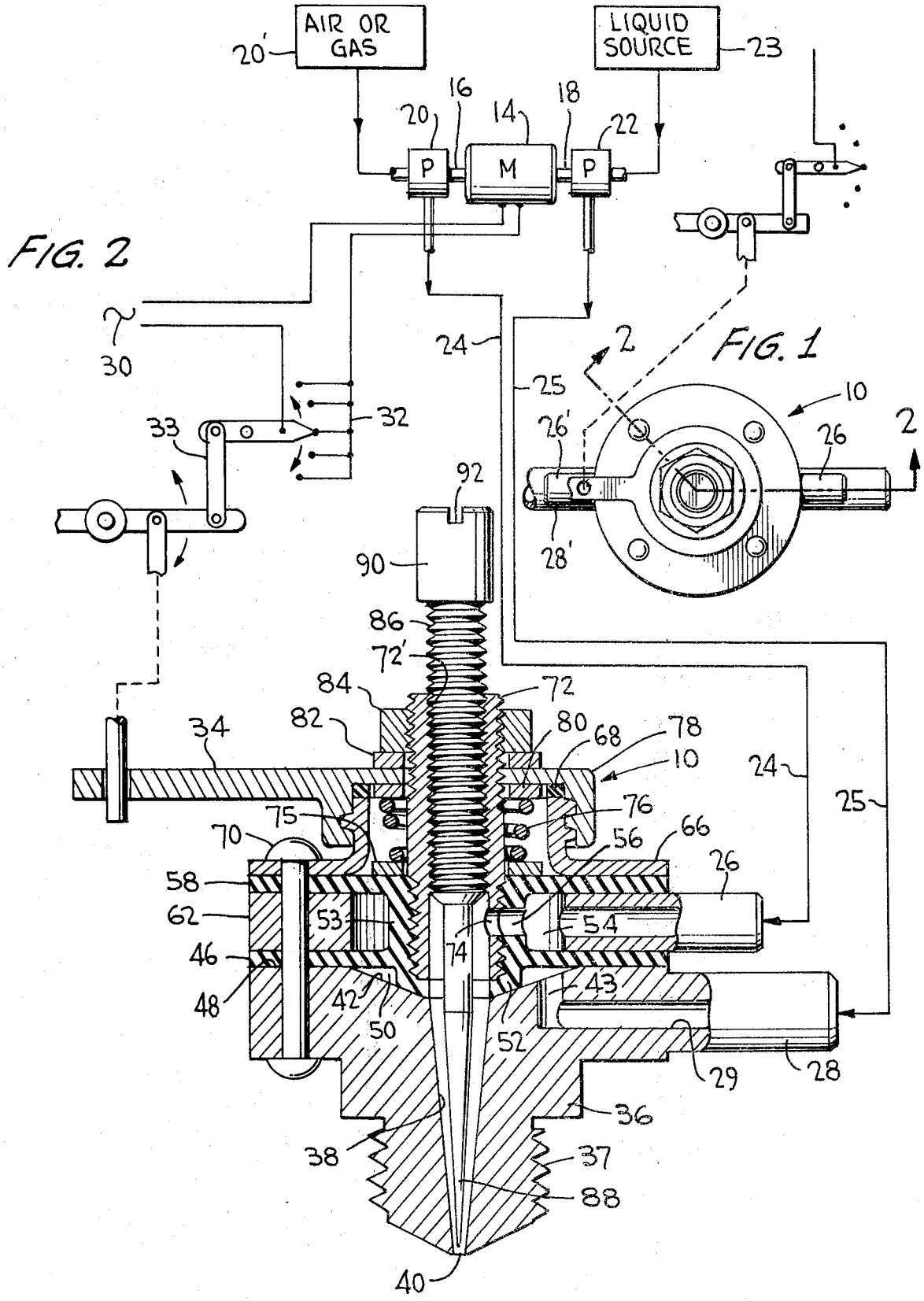
FIG. 1 is a top plan view of the novel atomizing nozzle.
FIG. 2 is an axial section of the nozzle of FIG. 1, taken substantially on the plane of line 2—2 of FIG. 1, showing diagramatically the system in which pressurized fluid (gas) and liquid are directed to the nozzle and controls for the system.

Referring to FIGS. 1 and 2, an atomizing valve assembly is indicated generally at 10 and, as will be explained in detail, the valve assembly 10 is operatively connected to a fluid-supply assembly 12. The fluid supply assembly 12 includes an electrically-operated motor 14 having at an armature projecting axially at opposite ends 16 and 18, respectively, drivingly connected to pumps 20, 22 of the centrifugal-discharge type, for example. Pump 20 is connected to a source of air or gas 20 and will pressurize gas through conduit 24 to an inlet nipple 26 of the valve assembly 10, and pump 22 communicates with a liquid source 23, and directs pressurized liquid through conduit 25 to an inlet nipple 28 of the valve assembly 10.

As seen in FIG. 1, secondary gas-inlet and liquid-inlet nipples 26′ and 28′, respectively, can be provided in the event a plurality of gases or liquids are to be dispersed.

The motor 14 is operated by a suitable source of electrical energy 30 controlled by a suitable rheostat control 32, and a mechanical linkage 33 is operatively connected to the valve assembly 10. The linkage can function to operate a control lever 34 of the valve assembly 10 as will subsequently be described.

Figures 3, 4:
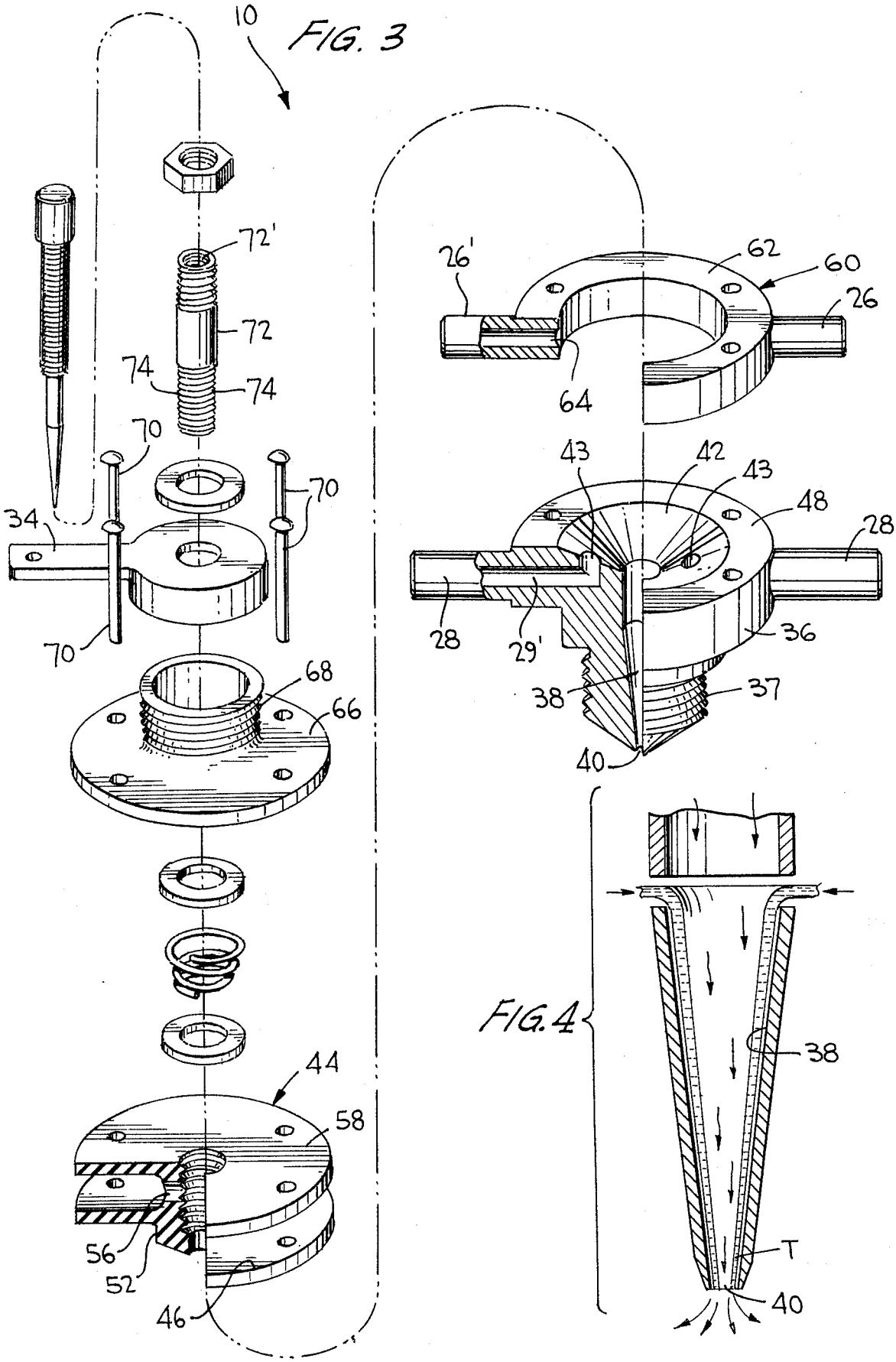
FIG. 3 is an exploded perspective view of the nozzle of FIGS. 1 and 2 showing details of assembly.
FIG. 4 is an enlarged fragmentary section of the conical bore of the atomization nozzle showing the theoretical path of the liquid.

The valve asembly 10, as seen in FIGS. 2 and 3, comprises a body portion 36 having a threaded nipple end 37 and an axial, conical bore 38 communicating at its forward end with an outlet orifice 40 and at its inner end with a shallow, conical valve seat 42; see FIG. 3. The body portion 36 has the integral nipples 28, 28′ having bore portions 29, 29′, which respectively open at the inner ends 43 into the shallow conical valve seat 42. A double-diaphragm 44 has a lower diaphragm 46 which will be seated on the upper surface 48 of the body portion 36 and define therebeneath a liquid manifold 50 in communication with the bore portions 29, 29′. Projecting axially from the diaphragm 46 is an integral, resilient valving element 52 which will sealingly engage the conical seat 42 inwardly of the openings 43 of the bores, and the double-diaphragm has internally-threaded axial opening sleeve 53 communicating with an annular gas manifold 54 through radial openings 56; the manifold being defined between the upper diaphragm 58 and lower diaphragm 46.

Interposed between the confronting surfaces of diaphragms 46, 58 is a connector element 60 comprising an annular ring portion 62 including the integral nipple portions 26, 26′ which nipple portions open at their inner ends 64 (only one shown) at the outer periphery of the gas manifold 54. Juxtaposed on the upper surface of diaphragm 58 is a cap member comprising a lower disc 66 and an upper, axially-projecting, externally-threaded sleeve 68. The body portion 36, diaphragms 46, 58, connector element 60 between the diaphragms, and disc 66 are suitably apertured to receive fastener elements 70 such as rivets, for example, therethrough so that the diaphragms provide seals or washers between assembled parts.

Threaded at its inner end is an assembly nipple 72 engaged within the sleeve 52 and apertured at 74 to communicate with the gas manifold 54. Circumposed about the nipple 72 and engaged on the outer surface of diaphragm 58 is a washer 75 engaged by one end of a compression spring 76. Threaded on the sleeve 68 is an adjustable cap 78 having the radial lever 34 for rotating the same, and the cap 78 is apertured so that the nipple 72 projects therethrough. Interposed between the outer end of spring 76 and the cap 78 is a second washer 80, and still another washer 82 surrounds the nipple 72 and engages the outer surface of cap 78. An abutment nut 84 is threaded on the nipple 72 and normally positions the nipple element in its seated position, i.e., due to the force applied to the nipple through compression spring 76 acting on the double diaphragm 44 and urging the valving element into its seated, sealing relationship on valve seat 42 as seen in FIG. 2.

The assembly nipple 72 is internally threaded at 72' above the apertures 74, and receives therein the threaded shank 86 or a conical needle 88 which projects into the conical bore 38, and the shank 86 has an enlarged head 90 and a transverse kerf 92 to accommodate a screw driver for adjusting the position of the needle 88 relative to the bore 38 and outlet orifice 40.

Before describing the operation, it will be observed that lever 34 is adjusted to control the initial or residual compression on springs 76 which acts through washer 74 axially of the double diaphragm to urge valving portion 52 onto the shallow conical seat 42. In the absence of sufficient liquid pressure in liquid manifold 50, no fluids are atomized. The gas or air pressure directed through conduit 24 and into the air manifold 54 will pass through the conical bore 38 and past the tip of needle 88 to the atmosphere.

Figure 6:
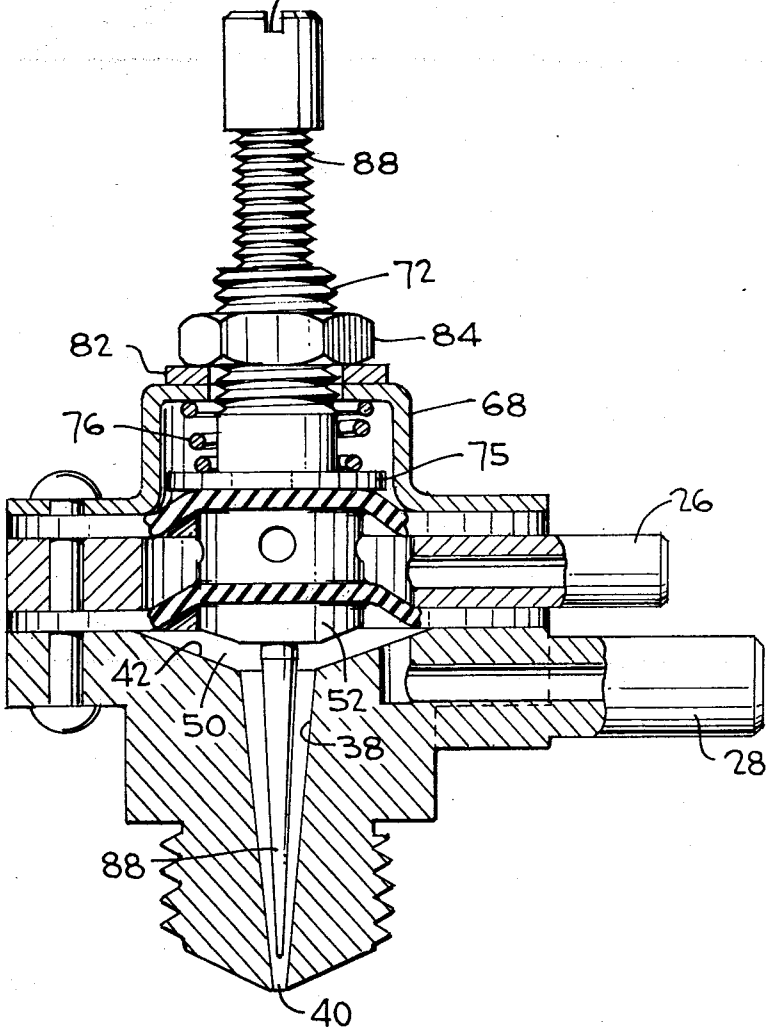
FIG. 6 is a view similar to FIG. 5, showing the alternate position of the parts.
Figure 5:
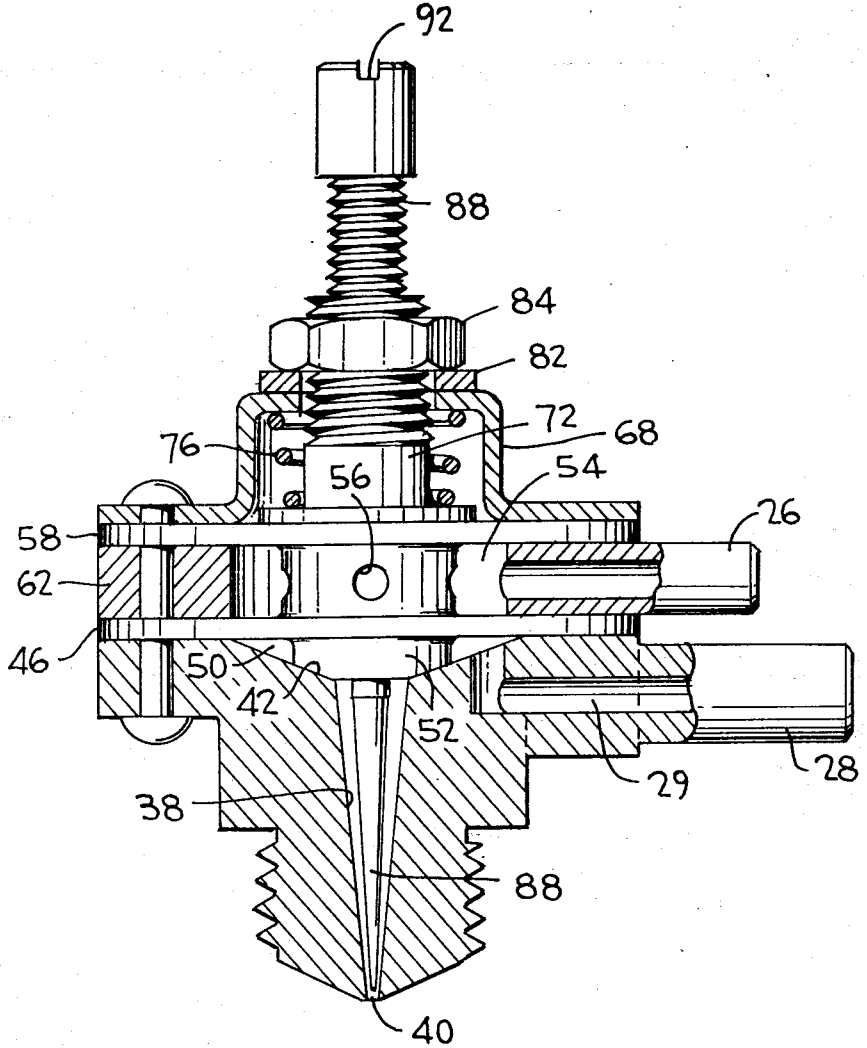
FIG. 5 is an axial section similar to FIG. 2, showing a slightly modified atomizing valve in which the diaphragm spring pressure is constant.

Referring to FIGS. 5 and 6, reference numerals similar to those used in FIGS. 1 through 3 are used to identify similar parts; the only difference between the embodiment of FIGS. 5 and 6, which are alternate inoperative and operative showings, respectively, when compared with FIGS. 1 through 3, is that the axial housing 68' is not externally threaded as in the earlier embodiment and thus the adjusting lever 34 is eliminated in FIGS. 5 and 6. The axial cap 68' is engaged by a washer 82 and the adjusting abutment nut 84; however, the residual pressure of spring 76 is constant.

Thus, when comparing FIGS. 5 and 6, it will be observed that the terminal end of the conical needle 88 is substantially disposed adjacent the outlet orifice 40 in FIG. 5, and the valving element 52 seals the liquid from passing from the liquid manifold 50 into the conical bore 38 of the atomzing nozzle. In FIG. 6, the valving element 52 is off its seat 42, thus permitting liquid from the manifold 50 to pass into the conical bore while at the same time pressurized gas passes axially about the needle 88, and is compressed and as pressure and velocity increases assumes a thin-layer configuration T adjacent the outlet orifice 40; see FIG. 4; and the pressurized air passes axially out of the liquid layer adhering to the inner surface of the conical bore 38. As the highly pressurized liquid and air mixture leaves to the outlet orifice, the mixture strikes the atmosphere at the outlet and the mixture is atomized or dispersed as a fine cloud or dispersion of atomized particles upon striking the ambient air.

OPERATION

Referring to FIG. 2 and in view of the alternate positions of the parts as illustrated in FIGS. 5 and 6, the atomzing valve is normally in the position shown in FIGS. 2 and 5. In this position, the motor 14 is not operated, the pumps 20, 22 are not pressurizing fluids, the liquid reservoir 50 is closed by valving element 52 urged into sealing relation by spring 76, the needle 88 has been adjusted to be positioned adjacent the outlet orifice 40, and the residual pressure on the diaphragm is provided by spring 76, or has been adjusted by lever 34 threaded on the sleeve 68.

Energizing the motor 14 from the power source 30 through operation of the rheostat 32 results in a liquid pressure buildup in liquid reservoir 50 while the gas or air pressure is increased. As seen in FIG. 4, the liquid will be compressed into a thin, high-velocity cone, when the needle 88 has been moved inwardly of the conical bore so that the high velocity fluids, i.e., gas and liquid mixture, are discharged into ambient air at the outlet orifice (where the mixture expands) as an atomized spray or dispersion.

The liquid will be dispersed upon demand, i.e., the liquid is not wasted, and must first be pressurized prior to discharge.

Referring to FIG. 2, the linkage 33 is shown diagramatically and as a practical matter, will be generally in the same plane as the horizontal lever 34; see FIG. 1, so that the lever 34 can be rotated in the horizontal plane in which it is disposed. The linkage 33 of FIG. 2 is arranged so that the rheostat 32 is operated and the lever 34 is moved to place pressure on nut 84 to raise the needle valve 80 and permit the relatively low pressure liquid in manifold 50 to be mixed with liquid as valving element 52 is moved off its valve seat through the action of lever 34.

Less complicated embodiments of the atomzing valve are contemplated. For example, in FIG. 7, a valve assembly is indicated generally at 100, the assembly including a valve body 136 having an intermediate seat flange 137 upon which a sealing gasket 139 is disposed. A connecting element 141 is threaded onto the body 136 and gasket 139 and includes at least one liquid-inlet nipple 128 having a bore opening into an inner, valve seat 142 and forming a liquid manifold 150. The body includes a conical bore 138 terminating in an outlet orifice 140 centrally of the valve seat 142.

A single diaphragm includes the diaphragm periphery 146 seated on the connecting element 141 and includes an axially apertured valving element 152 normally seated on the valve seat 142. A connecting nipple 172 projects into the valving element 152 and projects through an apertured cap 168 of a plate 166 juxtaposed on the outer surface of the diaphragm periphery 146, the parts being assembled by suitable fasteners such as rivets 170, for example.

A spring 176 is disposed within cap 168 and engages a washer 175 engaged with an upper end of the valving element 152. A washer 182 engages the outer end of the cap 168 and a valve-adjusting nut 184 is threaded on the connecting nipple 172.

Figure 7:
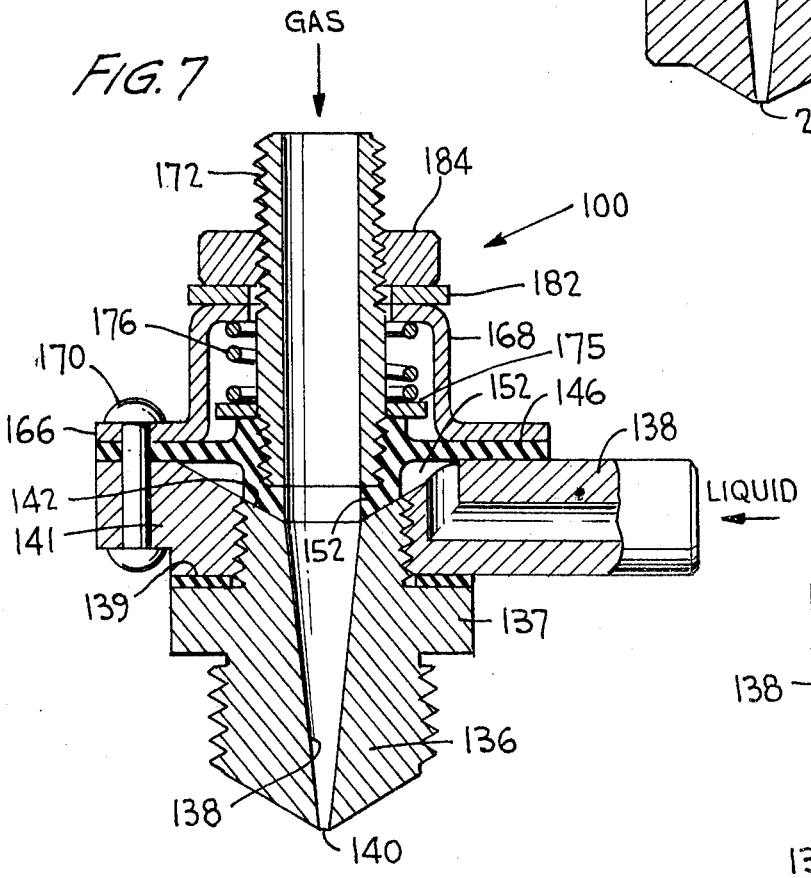
FIG. 7 is an axial section of another embodiment of the atomizing nozzle utilizing a single diaphragm.

Operation of the embodiment of FIG. 7 is essentially the same as that of FIGS. 2, or 5, 6; however, in this embodiment, it will be noted that the adjustment needle is eliminated. When gas is directed through the bore of the connecting nipple 172, conical bore 138 and out of orifice 140, pressurized liquid in liquid manifold 150 can function to react on the inner surface of the diaphragm 146, lifting the valving element 152 off the seat 142 whereby the liquid will be compressed and increased in velocity as it is driven toward the outlet orifice 140 where it is dispersed in the atmosphere, for example.

Figure 9:
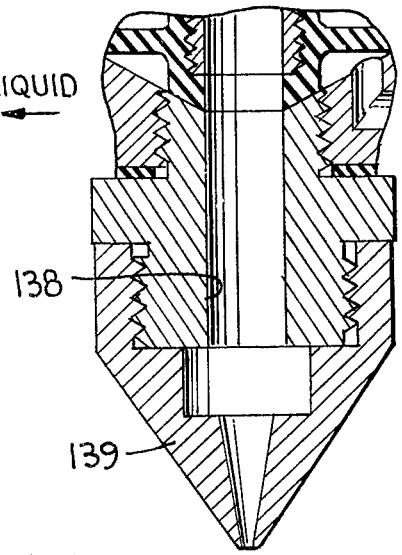
FIG. 9 is a fragmentary section similar to a portion of FIG. 7, in which the outlet bore is cylindrical, indicating how different shaped nozzles can be used.

Considering FIG. 9, an embodiment similar to FIG. 7 is shown fragmentarily; in this embodiment, instead of a conical bore, a cylindrical bore 138' is provided. In this embodiment, two different liquids could be readily mixed or, for example, two gases could be mixed. Various interchangable conically-bored nozzle elements 139 can be threaded onto the threaded end portion of the atomizing nozzle.

Figure 8:
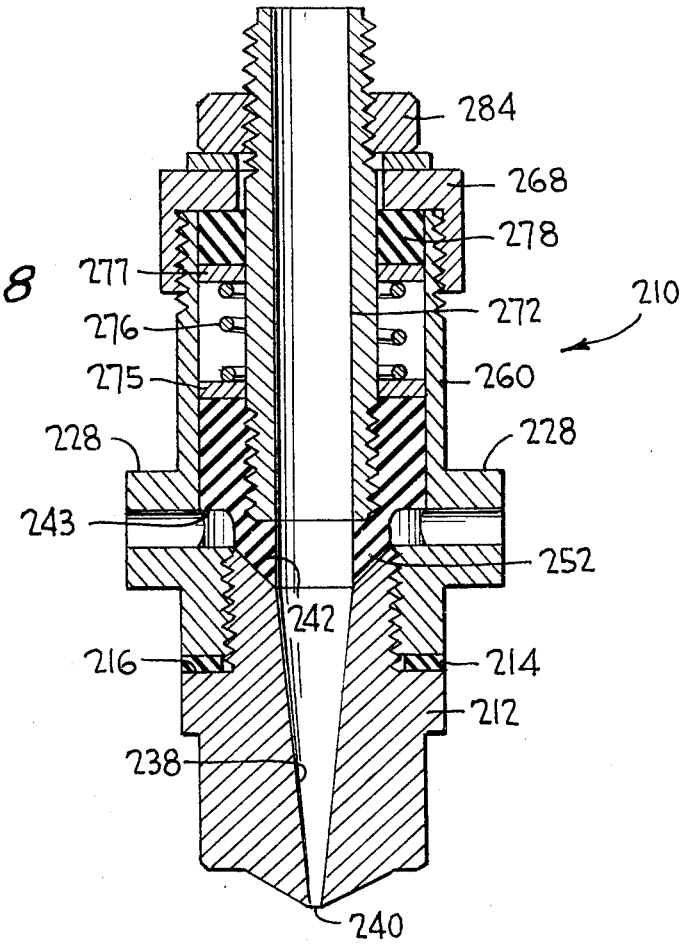
FIG. 8 is a view similar to FIG. 7, showing still another embodiment of the atomizing nozzle in which the diaphragm is replaced by a spring-urged valve.

In FIG. 8, the atomizing nozzle is indicated generally at 210, and comprises a body 212 having a conical bore 238 terminating in an outlet orifice 240. A sealing gasket 214 is received on flange 216, and an inner conical valve seat 242. Threaded on the body 212 is a connecting sleeve 260 having lateral nipple portions 228 to which will be connected a source of pressurized liquid. The sleeve 260 has displacably supported therein a valving element 252 seated on valve seat 242 undercut at 243 and providing a fluid-responsive reaction area communicating with the nipple portions. Mounted in the valving element 252 is threaded the inner end of a connecting nipple 272 about which is disposed a washer 275 engaged by a compression spring 276 abutting a washer and seal 227 and 278, respectively.

The sleeve 260 has threaded on its upper end an apertured cap 268 through which the threaded outer end of the connecting nipple 272 extends, and a washer 273 engages the outer surface of the cap 268, and an abutment nut 284 engages the washer.

Accordingly, when gas is pressurized through the connecting nipple 272, it passes into the conical bore 238 where it is compressed and its velocity increases. When the liquid pressure is sufficiently increased beneath the undercut 243 of the valving element 252, the valving element is moved off the seat and the axially pressurized gas picks up the liquid surrounding the valve seat and atomization takes place as the high-velocity mixture of gas and liquid are dispersed from the nozzle 240 and atomize when it drastically expands after leaving the orifice 240.

In summary, the following advantages are provided by the novel atomizing nozzle and system:

A relatively low gas pressure can be used with a relatively small amount of liquid, to obtain optimum atomization upon demand, i.e., when no atomizing is required, no liquid or gas pressure is generated.

Only when the liquid pressure has built up sufficiently in the liquid manifold, will the valving element be displaced off its valve seat (and since gas is being generated and discharged through the conical bore of the atomizing nozzles) when the valving element is moved off the valve seat, immediate and optimum atomization and dispersion of the liquid is obtained.

The metering pin serves to adjust to size of the outlet orifice of the atomizing nozzle for varying viscosities of the fluids being mixed.

The upstream location of the pressured gas intermixing with the liquid (after sufficient pressure builds up in the liquid manifold and lever 34 opens the valve seat to mixing pressurized gas and liquid) results in the thinned-out, high-velocity of the gas-liquid mixture on the inner surface of the conical bore of the nozzle to obtain atomizing velocities.

Adjustments through the needle valve and/or adjustment of the spring pressure on the valving element, permit control as to when the liquid will be atomized, at what pressure it will be atomized, and the size of the orifice through which the liquid-gas mixture will be atomized.

What is claimed is:

1. An atomizing nozzle comprising:

a body portion including a conical bore including an outlet orifice of reduced cross-section, and an inner inlet portion;

means for introducing pressurized gas to said inlet portion for carrying a liquid through the conical bore so that the liquid will be increased in velocity as it approaches the outlet orifice and is atomized as it exits from the outlet orifice and expands thereat;

a liquid introducing manifold surrounding said inlet portion for containing liquid to be carried by the gas passing through the conical bore; and valve means operatively connected between said liquid manifold and said inlet portion of said conical passage for controlling mixing of the liquid and gas as it enters said conical passage.

2. An atomizing nozzle as claimed in claim 1 in which said valve means comprises a valve seat surrounding said inlet portion, a valve element displacably supported on said valve seat and having a portion exposed to said liquid manifold to permit mixing of the pressurized gas and liquid upstream of the outlet orifice.

3. An atomizing nozzle as claimed in claim 2 including a compression spring engaging said valve element and normally biasing the valve element onto said valve seat.

4. An atomizing nozzle as claimed in claim 3 in which said valve means comprises at least one flexible diaphragm secured to said body portion about said valve seat, said valve element being integral with and projecting axially from said flexible diaphragm, said valve element having an axial passage communicating with the inlet portion of said conical bore.

5. An atomizing nozzle as claimed in claim 4 in which a connecting nipple is terminally seated in the axial passage of the valve element and is displaceable with said valve element, said spring being circumposed about said connecting nipple, a cap element overlying said body portion and abutting the compression spring, the connecting nipple projecting through said cap element, and a stop element secured to said connecting nipple and engaging said cap element.

6. The atomizing element as claimed in claim 5 in which said stop element includes means adjustably mounting the stop element along said connecting nipple for adjusting the sealing engagement of said valve element on said valve seat.

7. The atomizing nozzle as claimed in claim 6 in which said cap element comprises an externally threaded sleeve, a cap element adjustably mounted on said threaded sleeve and engaged with said spring for adjusting the pressure normally imposed on said diaphragm by said spring.

8. The atomizing nozzle as claimed in claim 7 in which said cap element includes a radially projecting lever for facilitating rotation of the cap element.

9. The atomizing nozzle as claimed in claim 5 in which said connecting nipple is internally threaded, and a conical metering pin adjustably mounted in said connecting nipple and terminally projecting into said conical passage of the body portion to control the size of the outlet orifice.

10. The atomizing nozzle as claimed in claim 3 in which said liquid manifold comprises a separate element mounted on said body portion and having the valve seat formed thereon, said element including at least one nipple having a passage portion terminating in said valve seat outwardly of the valving element, said valve means comprising at least one flexible diaphragm integral with the valving element and overlying said valve seat and defining one side of the liquid manifold.

11. The atomizing nozzle as claimed in claim 3 in which said body portion comprises an integral nipple element terminating in said valve seat outwardly of said valving element, said valving element comprising a pair of flexible diaphragms integral with an axial tubular portion, a mounting nipple terminally secured in said axial tubular portion of the diaphragm, an element mounted between said diaphragms and having an annular ring portion defining a gas manifold for pressurized gas, said axial tubular portion between said diaphragms including aperture portions communicating between the gas manifold and said conical passage of the body portion of the nozzle upstream of the liquid manifold.

12. A system for atomizing liquids comprising in combination:

a power means having power takeoff means for simultaneously driving a pair of pump assemblies;

a gas pump and liquid pump operatively connected to said power takeoff means, said pumps respectively including means for receiving a gas and liquid to be atomized; and an atomizing nozzle comprising a conical bore including an outlet orifice and an inner inlet portion, said gas pump including an outlet operatively connected to said inlet portion of the conical passage, a liquid introducing manifold surrounding the inlet portion, said liquid pump including an outlet portion for directing pressurized liquid to said liquid manifold, and valve means between said liquid manifold and said inlet portion of the conical passage, said valve means including a valve seat defining a portion of the liquid manifold, a valve element displaceably supported on said valve seat and having a portion exposed to and subject to pressures developed in said liquid manifold, and means for operating the motor and pumps simultaneously to cause pressurized gas and liquid to be simultaneously directed to said atomizing nozzle.

* * * * *